US007036443B2

(12) United States Patent
Wahlström

(10) Patent No.: US 7,036,443 B2
(45) Date of Patent: May 2, 2006

(54) NEEDLE GUARD

(75) Inventor: Rolf Wahlström, Jönköping (SE)

(73) Assignee: VSM Group AB, Huskvarna (SE)

( * ) Notice: Subject to any disclaimer, the term of this patent is extended or adjusted under 35 U.S.C. 154(b) by 145 days.

(21) Appl. No.: 10/725,077

(22) Filed: Dec. 2, 2003

(65) Prior Publication Data

US 2004/0107886 A1 Jun. 10, 2004

(30) Foreign Application Priority Data

Dec. 2, 2002 (SE) ..... 0203573

(51) Int. Cl.
*D05B 57/26* (2006.01)

(52) U.S. Cl. ..... 112/231; 112/227

(58) Field of Classification Search ..... 112/227, 112/231, 230, 196, 181, 228, 261
See application file for complete search history.

(56) References Cited

U.S. PATENT DOCUMENTS 4,009,670 A * 3/1977 Mitchell ..... 112/231
4,660,485 A * 4/1987 Morgan ..... 112/467
4,858,543 A 8/1989 Badillo
5,188,046 A 2/1993 Badillo
5,189,972 A 3/1993 Mitsui et al.
5,974,995 A * 11/1999 Sato ..... 112/181
6,076,477 A 6/2000 Badillo
6,745,712 B1 * 6/2004 Fujinaga et al. ..... 112/181

FOREIGN PATENT DOCUMENTS

DE 69204337 10/1992

* cited by examiner

*Primary Examiner*—Ismael Izaguirre
(74) *Attorney, Agent, or Firm*—Venable LLP; Eric J. Franklin

(57) ABSTRACT

A gripper hook for a sewing machine. The sewing machine includes a needle, a stitch plate and a housing for the gripper hook. The gripper hook includes an open cylinder and is rotatably mounted on a horizontal axis. A bobbin basket is supported inside the gripper hook receives a bobbin case. The bobbin case houses a bobbin. The needle, in executing a stitch, is brought down perpendicular to the axis of the gripper hook in front of the open part of the gripper hook through an opening in the wall of the bobbin basket such that a gripper hook tip catches the upper thread and leads the upper thread around the bobbin basket. The gripper hook has a side wall that is at least wide enough for the side wall to protect the bobbin basket from being struck by the needle when the needle tip is out of alignment.

9 Claims, 5 Drawing Sheets

NEEDLE GUARD

BACKGROUND OF THE INVENTION

The invention relates to a method and a device in a sewing machine for protecting a bobbin basket made of plastic from wear that is caused due to the fact that a threaded needle in an up and down stitching movement strikes the surface of the bobbin basket when the needle, for various reasons, goes askew.

DESCRIPTION OF THE PRIOR ART

Examples of the prior art relating to rotary gripper hooks in lockstitch machines are to be found in the patent specifications U.S. Pat. No. 4,858,543 and U.S. Pat. No. 5,188,046 and elsewhere. The said specifications describe the advantages of using plastic bobbin baskets instead of making the bobbin baskets from steel as was formerly the usual practice.

In order to explain the terminology an example of the prior art will be described with reference to FIGS. 1 and 2. These figures show a rotary gripper hook, which is intended for mounting on a horizontal axis coupled to the sewing machine drive element. The rotary gripper hook consists of a circular shaped bottom plate 2 with a cylindrical side wall 3, which in one direction extends perpendicularly out from the periphery of the bottom plate. Inside a cylindrical cavity in the gripper hook a bobbin basket 4 is supported concentrically with the gripper hook. The bobbin basket 4 houses a bobbin case (not shown), in which a bobbin with under thread can be mounted. The bobbin basket 4 is mounted in said cavity by fitting a flange 6 running around the bobbin basket into an inward facing notch 7 in the outermost part of the gripper hook side wall 3. The bobbin basket is then held in place by fixing an annular hoop 8 against the circular-shaped back of the side wall, a groove 9 being formed in the gripper hook which permits a sliding and rotational movement of the gripper hook relative to the bobbin basket, which is immobilized by a stop. Mounted vertically and adjoining the gripper hook, a needle 5 which carries an upper thread threaded through an eye in the needle, runs with an up and down movement. In sewing stitches the tip of the needle is first brought down outside the rotating hoop and through a small opening in the wall of the bobbin basket. This opening only occurs along the peripheral wall of the bobbin basket when the needle tip penetrates through the peripheral wall into the bobbin basket. On the gripper hook is a gripper hook tip 10, which catches a loop formed in the upper thread when the needle turns, the gripper hook though its rotation carrying the upper thread round the bobbin basket and in the process forming a stitch by interaction with the under thread situated inside the bobbin basket, when the needle is brought back upwards.

Under certain conditions it can happen that the needle, due to lateral forces, becomes slightly inclined, or is pressed sideways by lateral forces when embroidering fabric or when sewing thick material, for example. In this context there is a risk of the needle tip striking the upper, outer part of the wall of the bobbin basket. In the prior art according to the specifications cited above, this problem is solved by reinforcing the outer part of the wall of the bobbin basket on the top facing the needle with a steel needle guard 12. This needle guard 12 complicates the manufacture of the bobbin basket, since in production terms this means that the plastic bobbin basket has to be integrated in a number of stages with the small steel piece that forms the needle guard 12. This makes the cost of manufacturing a bobbin basket unnecessarily high.

SUMMARY OF THE INVENTION

According to a first aspect of the invention this involves the provision of a gripper hook in a lockstitch sewing machine, the sewing machine comprising a vertically mounted needle for an upper thread, a stitch plate, below the stitch plate a housing that accommodates said gripper hook, which is substantially formed into an open cylinder and is rotatably supported on a horizontal axis, a bobbin basket which is concentrically supported inside the gripper hook and is formed as an open cylinder for receiving a bobbin case, the bobbin case housing a bobbin for an under thread and the needle in executing a stitch being brought down perpendicularly to the axis of the rotary gripper hook in front of the open part of the gripper hook through an opening in the wall of the bobbin basket, a gripper hook tip catching the upper thread, leading the upper thread round the bobbin basket and in the process forming a stitch by interaction with the under thread when the needle is brought back up, and the gripper hook having a cylindrical side wall which is as least wide enough for the side wall to protect the bobbin basket from being struck by the needle in a situation in which the needle is brought downwards when a force is pressing the tip of the needle out of an alignment in which the needle normally runs.

In a preferred embodiment a gripper hook hoop, which according to the prior art is mounted on the back of the side wall, is made somewhat wider than was usual according to the prior art, the side wall being made wider overall. In this description the term wide relates to its extent in the axial direction of the gripper hook.

When the gripper hook side wall is made wider according to the invention there is a risk that the loop formation that must come about the needle turns will be adversely affected due to the fact that the space between the gripper hook and the opposite wall on the other side of the needle facing the gripper hook will become too restricted. As a result it is possible that the rotary gripper hook tip will miss the loop, thereby missing a stitch. One embodiment of the invention affords a solution to this in that the side wall is made full width only along that part of the periphery of the gripper hook side wall where the needle is situated up against the rotary gripper hook during formation of the thread loop.

Designing the gripper hook in accordance with this proposal means that the bobbin basket can be made entirely of plastic, which makes production of the bobbin basket easier and less expensive.

DESCRIPTION OF THE PREFERRED EMBODIMENTS

A number of examples of embodiments of the invention are described here with reference to drawings attached.

Figure 1:
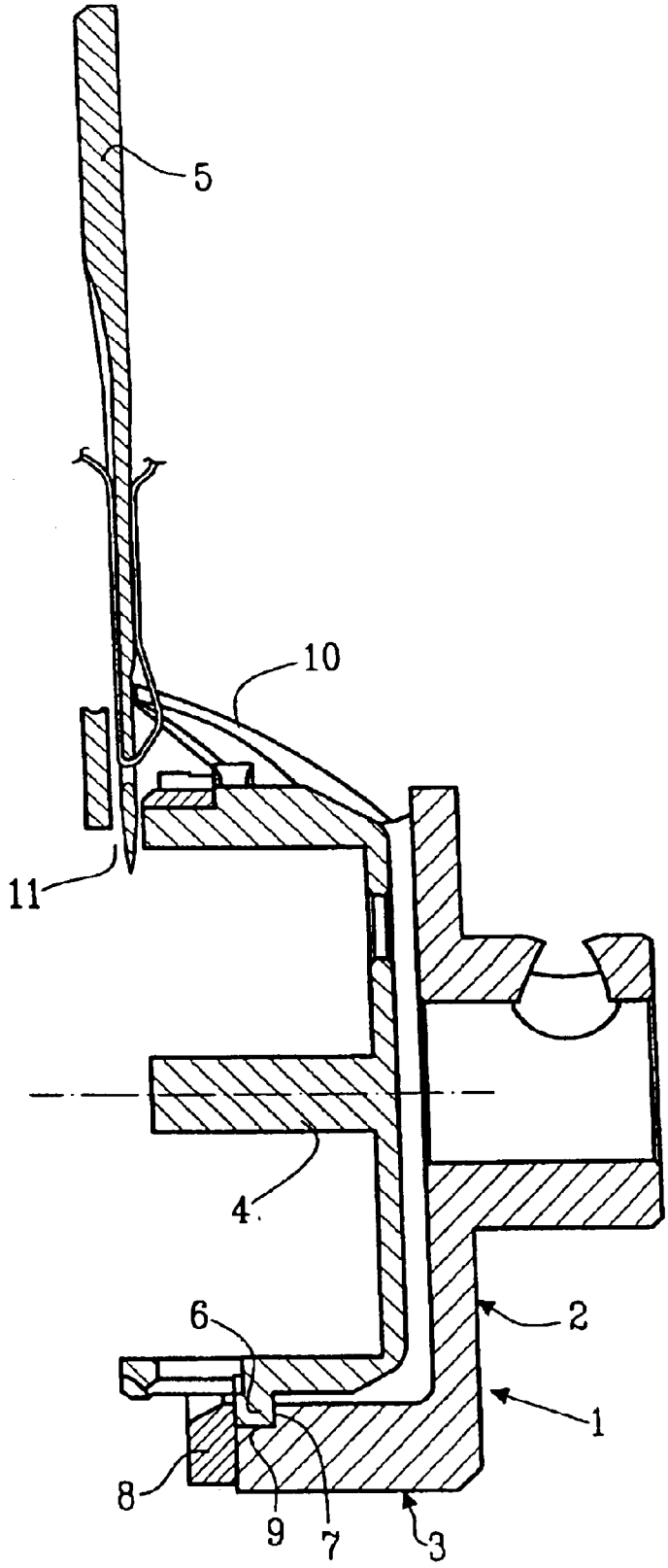
PRIOR ART FIG. 1
FIG. 1 shows an axial cross-section through the gripper hook, bobbin basket, bobbin case, bobbin and needle, from which it will be seen how the gripper hook tip catches a thread loop behind the needle according to the prior art.
Figure 2:
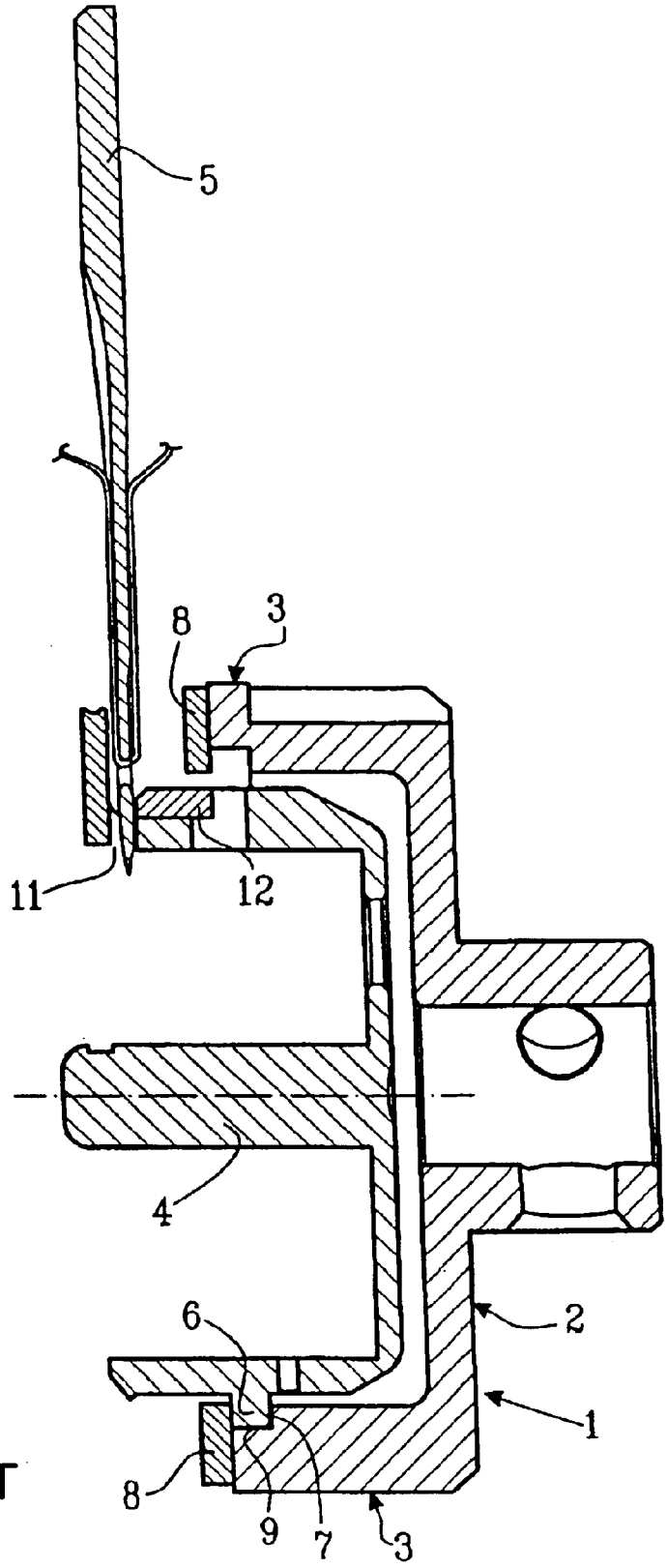
PRIOR ART FIG.2
FIG. 2 shows, in schematic form, the cross-sectional contours in an axial section through a gripper hook with bobbin basket and needle according to the prior art.

FIG. 1 shows a known embodiment of a rotary gripper hook 1, which is intended for mounting on a horizontal axis, which is coupled to the sewing machine drive element. The rotary gripper hook consists of a circular-shaped bottom plate 2 with a cylindrical side wall 3, which in one direction extends perpendicularly out from the periphery of the bottom plate. Inside a cylindrical cavity in the gripper hook a bobbin basket 4 is supported concentrically with the gripper hook. The bobbin basket 4 houses a bobbin case (not shown), in which a bobbin with under thread can be mounted. The bobbin basket 4 is mounted in said cavity by fitting a flange 6 running virtually all round the bobbin basket into an inward facing notch 7 in the outermost part of gripper hook side wall 3. The cylindrical side wall 3 of the gripper hook 1 comprises an annular hoop, the gripper hook hoop 8, at the open end of the gripper hook. The bobbin basket 4 is held in place by means of the gripper hook hoop 8, which through its fixing in the side wall 3 of the gripper hook 1 by interaction with the notch 7 forms a groove 9, which permits sliding and rotating movement of the gripper hook relative to the bobbin basket, which is immobilized by a stop. The gripper hook hoops 8 referred to here are not complete circles, since this would prevent the thread being carried around the bobbin basket. Mounted vertically and adjoining the gripper hook, a needle 5 which carries an upper thread threaded through an eye in the needle, runs with an up and down movement. In sewing stitches the tip of the needle is first brought down outside and up against the rotary gripper hook and through a small opening 11 in the wall of the bobbin basket. This opening only occurs along the peripheral wall of the bobbin basket when the needle tip penetrates radially through the peripheral wall into the bobbin basket. On the gripper hook is a gripper hook tip 10, which catches a loop formed in the upper thread when the needle turns upwards, the gripper hook though its rotation carrying the upper thread round the bobbin basket 4 and in the process forming a stitch by interaction with the under thread situated inside the bobbin basket, when the needle is brought back upwards, as is shown in FIG. 1. At the inner edge of the opening 11 there is a needle support 12 for supporting the needle in a horizontal direction. In the bobbin basket according to the invention this needle support 12 can be made of plastic and integrally molded with the bobbin basket.

Figure 3:
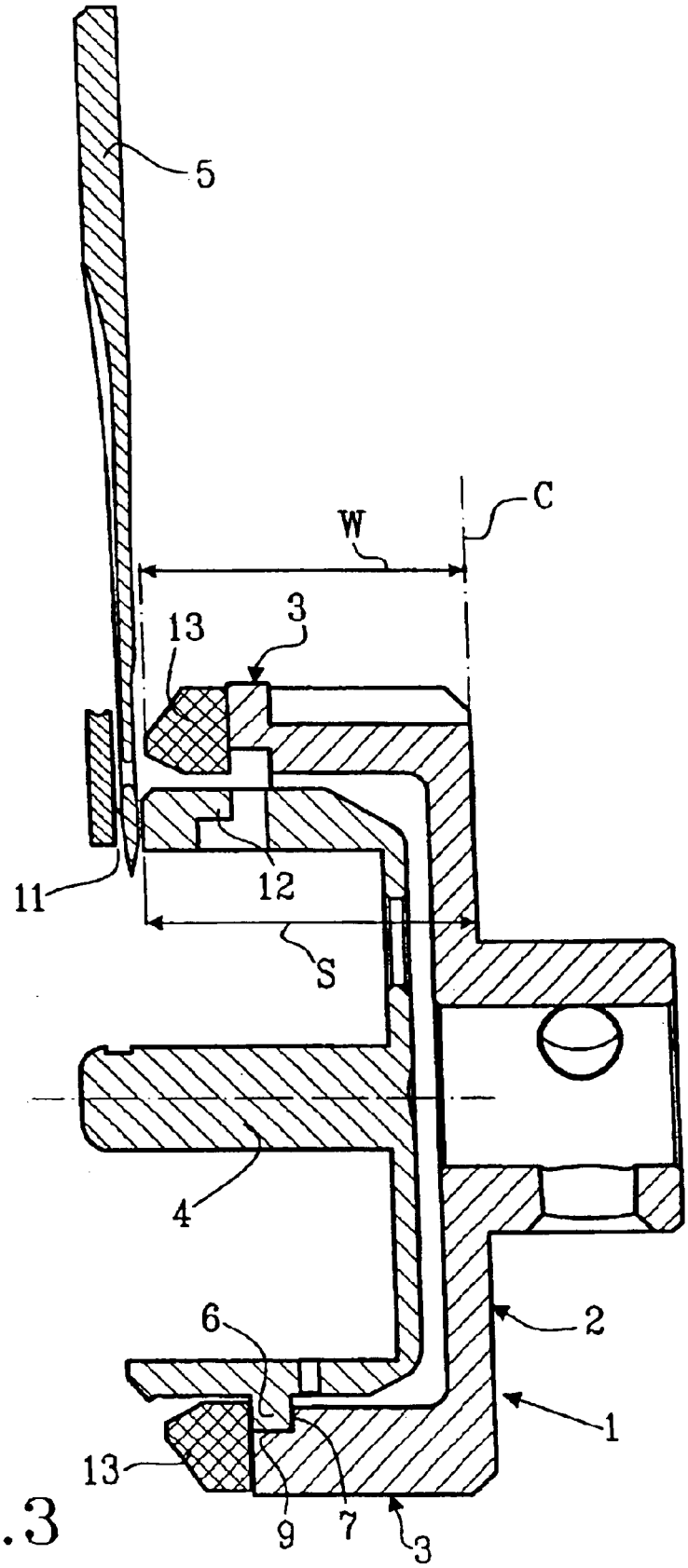
FIG. 3 shows, in schematic form, the cross-sectional contours in a corresponding axial cross-section through a gripper hook with bobbin basket and needle according to one aspect of the invention.

According to a variant of the invention the gripper hook side wall 3 is designed so wide that it extends virtually right up to the opening 11 in the bobbin basket, that is to say virtually right to the outer edge of the needle support 12 on the bobbin basket, which can be seen from FIG. 3. The needle in its downward movement will thereby be correctly guided down into the opening 11 and be supported against the needle support 12 in a horizontal direction. If for any reason the needle is bent, slanting or pressed sideways by forces, the needle will strike against the upper outermost part of the side wall 3 of the gripper hook and thereby protect the underlying needle support 12 if the needle tip should have a direction of movement such that the needle support would otherwise have been struck. The outermost part of the side wall is furthermore chamfered at an angle so that the needle is guided down into the opening 11, even if the line which the needle is currently following should deviate slightly from the correct alignment of the needle movement. In order to keep the bobbin basket in place, as stated earlier, a hoop 13 in the shape of an incomplete ring is attached, this being affixed to the inside of the side wall 3 at its outermost part or as a detachable widening of the side wall 3 in order to simultaneously provide the groove 9, by means of which the gripper hook, in its rotation, is made to run on the flange 6 of the bobbin basket.

In order to further illustrate the object of the invention, FIG. 3 shows how the gripper hook bottom plate 2 lies on a base plane C. From the bottom plate 2 the cylindrical side wall 3 extends perpendicularly outwards from the base plane C in one direction. In the figure the width of the gripper hook side wall 3 (including the gripper hook hoop 13), measured from the base plane C to the back thereof facing the needle 5, is marked by w. This width of the gripper hook side wall 3 (including the gripper hook hoop 13) is such that the side wall extends virtually right up to the outer edge of the needle support 12, or to put it another way virtually right up to the inner edge of the opening 11 in the bobbin basket 4. This distance, that is to say the distance from the base plane C to the outer edge of the needle support 12 is termed distance s in FIG. 3. According to the invention, the width w of the side wall 3 of the gripper hook 1 from the base plane C is thereby almost equal to the distance s. The deviation s-w should lie in the range 0 mm<s-w<0.3 mm.

Since an outer annular part of the gripper hook side wall is usually designed as a detachable gripper hook hoop 13, the function of which is also to hold the bobbin basket in place with the gripper hook supported in a groove 9 that is created by fitting the gripper hook hoop against the remainder of the side wall 3, the object of the invention can be achieved in a number of different ways. A first variant of the invention is designed as shown in FIG. 3, in which the cylindrical part of the side wall 3 only extends up to the notch 7, a gripper hook hoop 13 being connected to the annular end of the cylindrical part of the side wall 3. In this case the gripper hook hoop 13 has a width such that the width of the gripper hook hoop together with the cylindrical part of the side wall augment the width w according to the above. In another variant of the invention the cylindrical side wall is designed with the entire width consisting of the width w according to the above, the side wall 3 having a notch 7 which together with an annular gripper hook hoop 13, in this embodiment fitted to the inside of the side wall 3, creates the groove 9 for locking the bobbin basket 4 in the groove 9 formed.

Figure 4:
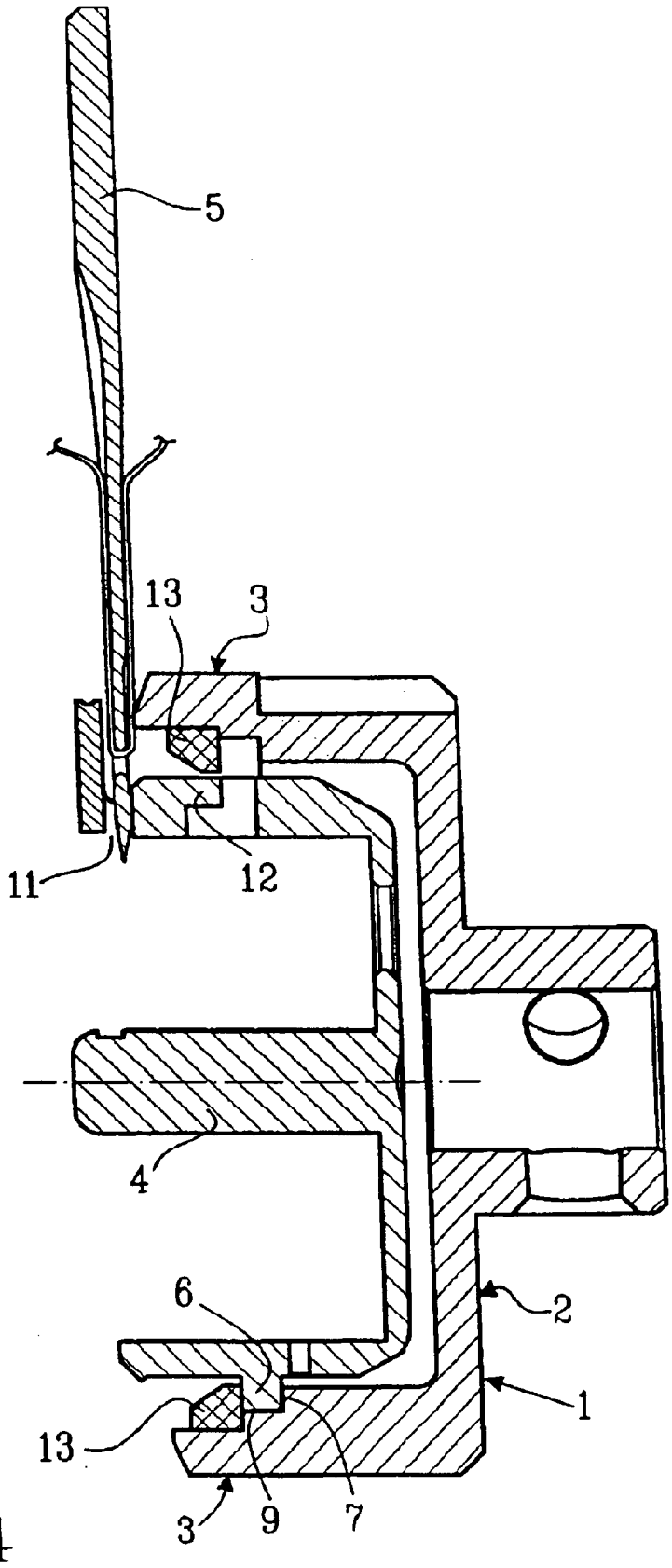
FIG. 4 represents the cross-sectional contours in a design variant of the gripper hook side wall according to the invention.
Figure 5:
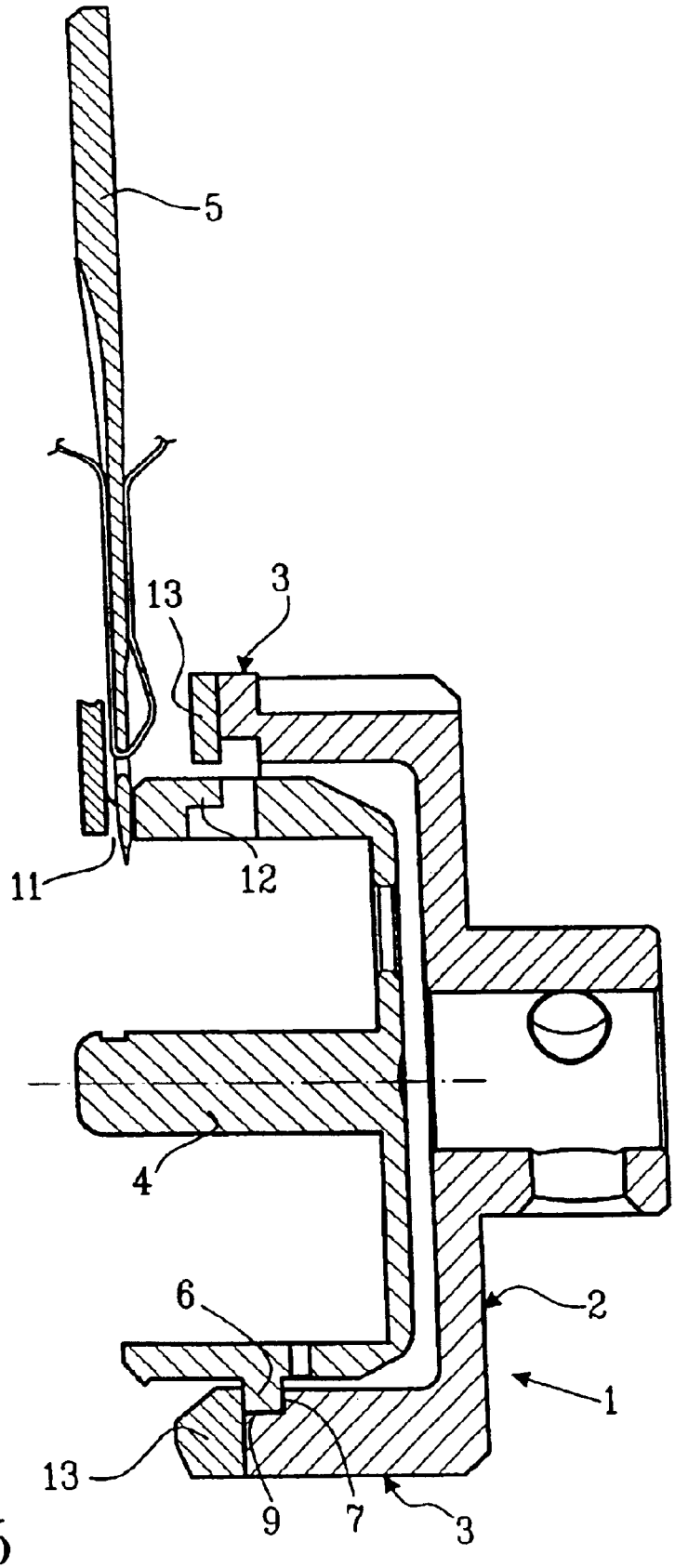
FIG. 5 illustrates the formation of a thread loop when the needle is on the way up and also shows an embodiment in which the gripper hook side wall is narrower in that part of the periphery where the gripper hook side wall, during its rotation, passes the needle in forming a thread loop.

As previously stated, the wide design of the gripper hook side wall 3 can adversely affect the formation of a thread loop, when the needle 5 turns upwards from its lowest position. In order to solve this, the side wall can be made narrower than the width w in that part of gripper hook side wall which rotates past the needle position at the tip when the needle returns upwards and forms said loop. Such an embodiment is shown in FIG. 5, in which the gripper hook hoop 13 is designed narrower at that part of the side wall 3 adjoining the needle position when it turns in the lowest position, which can be seen indicated in the upper part of the gripper hook hoop 13. In the same way, if the side wall is made full width according to the example in FIG. 4, the side wall can be made narrower than the width w in the position where the gripper hook side wall 3 faces the needle in its turning position.

What is claimed is:

1. A gripper hook in a lock stitch sewing machine, in which the sewing machine comprises a vertically mounted needle for an upper thread, a stitch plate, below the stitch plate a housing which accommodates said gripper hook, substantially formed into an open cylinder and rotatably mounted on a horizontal axis, a bobbin basket which is concentrically supported inside the gripper hook and is designed as an open cylinder for receiving a bobbin case, the bobbin case housing a bobbin for an under thread and the needle in executing a stitch being brought down perpendicularly to the axis of the rotary gripper hook in front of the open part of the gripper hook through an opening in the wall of the bobbin basket so that a gripper hook tip catches the upper thread and leads the upper thread around the bobbin basket, thereby forming a stitch by interaction with the under thread when the needle is brought back up, wherein the gripper hook has a cylindrical side wall which is at least wide enough for the side wall to protect the bobbin basket from being struck by the needle in a situation in which the needle is brought downwards when a force is pressing the tip of the needle out of an alignment in which it normally runs.

2. The gripper hook as claimed in claim 1, wherein the gripper hook has a circular-shaped bottom plate in a base plane and wherein the side wall of the gripper hook extends out from the bottom plate to a width w from the base plane, and wherein the deviation s-w of the width from a distance s spanned by the distance from the base plane up to the edge of the opening for the needle in the bobbin basket lies in the range 0 mm<s-w<0.3 mm, at least along that part of the side wall which during rotation of the gripper hook is situated just in front of the vertical line of the needle and at the same time below or on a level with the tip of the needle.

3. The gripper hook as claimed in claim 1, wherein the side wall of the gripper hook has its annular edge facing the needle chamfered, so that the needle tip is guided down towards the opening in the bobbin basket.

4. The gripper hook as claimed in claim 1, wherein a part of the side wall nearest the back of the side wall consists of a detachable gripper hook hoop fitted edge to edge with the remainder of the side wall.

5. The gripper hook as claimed in claim 4, wherein the gripper hook hoop is wider over at least half of its periphery.

6. The gripper hook as claimed in claim 1, wherein a part of the side wall nearest the back of the side wall consists of a detachable gripper hook hoop mounted on the inside of the side wall and wherein the side wall is wider over at least half of its periphery.

7. The gripper hook according to claim 1, wherein the bobbin basket is made entirely of a plastic material.

8. A method of protecting a bobbin basket from being struck by the needle in the up and down movement of the needle in a lockstitch sewing machine comprising a vertically mounted needle for an upper thread, a stitch plate, below the stitch plate a housing which houses a gripper hook which is substantially formed into an open cylinder and is rotatably mounted on a horizontal axis, a bobbin basket which is concentrically supported inside the gripper hook and is designed as an open cylinder for receiving a bobbin case, the bobbin case housing a bobbin for an under thread, the method comprising:

the bobbin basket is designed with a needle support on the uppermost part of the wall of the bobbin basket for supporting the needle in a horizontal direction in the lowest position of the needle and the needle support is protected from the needle during the sewing of stitches by a cylindrical side wall of the gripper hook wide enough for the side wall to cover the needle support to such an extent that the needle cannot strike the needle support.

9. The method according to claim 8, wherein the bobbin basket is made entirely of a plastic material.

* * * * *